US005543824A

United States Patent [19]

Priem et al.

[11] Patent Number: 5,543,824

[45] Date of Patent: Aug. 6, 1996

[54] APPARATUS FOR SELECTING FRAME BUFFERS FOR DISPLAY IN A DOUBLE BUFFERED DISPLAY SYSTEM

[75] Inventors: Curtis Priem, Fremont; Chris Malachowsky, Santa Clara; Bruce McIntyre, Cupertino; Guy Moffat, Palo Alto, all of Calif.

[73] Assignee: Sun Microsystems, Inc., Mountain View, Calif.

[21] Appl. No.: 520,301

[22] Filed: Aug. 28, 1995

Related U.S. Application Data

[63] Continuation of Ser. No. 353,792, Dec. 8, 1994, abandoned, which is a continuation of Ser. No. 999,198, Dec. 23, 1992, abandoned, which is a continuation of Ser. No. 716,001, Jun. 17, 1991, abandoned.

[51] Int. Cl.[6] ..... G09G 1/02

[52] U.S. Cl. ..... 345/201; 345/189; 395/164

[58] Field of Search ..... 345/190, 185, 345/187, 189, 197, 201; 395/164, 165, 166, 121; 348/567

[56] References Cited

U.S. PATENT DOCUMENTS

| | | | |
|---|---|---|---|
| 4,496,976 | 1/1985 | Swanson et al. | 358/147 |
| 4,609,917 | 9/1986 | Shen | 395/121 |
| 4,777,485 | 10/1988 | Costello | 345/190 |
| 4,841,292 | 6/1989 | Zeno | 340/799 |
| 4,862,154 | 8/1989 | Gonzalez-Lopez | 340/799 |
| 4,910,683 | 3/1990 | Bishop et al. | 340/798 |
| 4,954,819 | 9/1990 | Watkins | 340/721 |
| 5,034,817 | 7/1991 | Everett, Jr. | 358/160 |
| 5,061,919 | 10/1991 | Watkins | 340/721 |

*Primary Examiner*—Richard Hjerpe
*Assistant Examiner*—Doon Chow
*Attorney, Agent, or Firm*—Blakely, Sokoloff, Taylor & Zafman

[57] ABSTRACT

A double buffered output display system including a first frame buffer, a second frame buffer, a multiplexor for furnishing data to an output display from one of the first or the second frame buffers, apparatus for storing a signal indicating that the multiplexor is to select a different frame buffer to furnishing data to an output display, and apparatus for furnishing the stored signal to the multiplexor only at the completion of a frame on a display and before a new frame commences.

4 Claims, 1 Drawing Sheet

APPARATUS FOR SELECTING FRAME BUFFERS FOR DISPLAY IN A DOUBLE BUFFERED DISPLAY SYSTEM

This is a continuation of application Ser. No. 08/353,792, filed Dec. 8, 1994, now abandoned, which is a continuation of application Ser. No. 07/999,198, filed Dec. 23, 1992, now abandoned, which is a continuation of application Ser. No. 07/716,001, filed Jun. 17, 1991, now abandoned.

BACKGROUND OF THE INVENTION

1. Field of the Invention

This invention relates to computer display systems and, more particularly, to an apparatus for controlling the switching between frame buffers in a double buffered display system so that frame tearing does not occur.

2. History of the Prior Art

A typical computer system generates data which is displayed on an output display. This output display is typically a cathode ray tube which produces a number of full screen images one after another so rapidly that to the eye of the viewer the screen appears to display constant motion when a program being displayed produces such motion. In order to produce the individual images (frames) which are displayed one after another, data is written into a frame buffer. The frame buffer stores information about each position on the display which can be illuminated (each pixel) to produce the full screen image. For example, a display may be capable of displaying pixels in approximately one thousand horizontal rows each having approximately one thousand pixels. All of this information in each frame is written to the frame buffer before it is scanned to the display.

When data describing an entire picture exists in the frame buffer, the frame may be transferred to the display. Typically, data is transferred from the frame buffer to the display pixel by pixel and line by line beginning at the upper left hand corner of the display and proceeding horizontally from left to right, line by line, downward to the lower right hand corner of the display. In order for the picture to appear continuous on the output display, the successive frames in the frame buffer must be constantly scanned to the output display at a rate of thirty frames per second or more.

While each frame of data is being scanned to the display, new data to appear in a succeeding frame must be transferred to the frame buffer. In general, only data which is changing replaces old data in the frame buffer. This occurs at frame buffer positions representing those pixel positions which are changing on the screen. All unchanged data remains in the frame buffer without change. New data to be displayed in a frame may be written to the portion of the frame buffer being changed at any time. In order to allow information to be both written to the frame buffer and scanned from the frame buffer to the output display simultaneously, two ported video random access memory (VRAM) is used for the frame buffer. Data is written through one port and scanned to the display through the other.

If data is being placed in a VRAM frame buffer at the same time that information is being scanned to the display, it is possible that information being scanned to the display will come from two time displaced frames. For example, if scanning is proceeding at a faster rate than data is being written to the frame buffer and a portion of the frame buffer which is changing (being written) is scanned to the display, a portion of the display will be from what should be a first frame and a portion from what should be a succeeding frame. The display of portions of two time displaced frames simultaneously is called frame tearing. The visual effect is half drawn objects on the screen. This can be disconcerting where the display is rapidly changing as in real time video, for images may be grossly distorted.

In order to eliminate frame tearing, double buffered display memory is used. Double buffering uses two complete frame buffers each of which may store one entire frame. Data is written to one frame buffer and scanned to the display from the other. In its simplest form, this is accomplished using a pair of VRAM frame buffers and multiplexing the data in one or the other of the frame buffers to the display. In this form, data is never written to a frame buffer during the time its contents are being scanned to the display. Once a frame has been completely written, it may in turn be scanned to the display and data written to the other frame buffer. Since data is never written to a frame buffer while its contents are being scanned to the display, frame tearing cannot occur.

Since in a double buffered system only whole frames are actually displayed one after another on the output display to create a picture, the instant at which the multiplexor switches from scanning data in one frame buffer to the display to scanning data in the other to the display may occur only during a period after one frame is completely scanned and the next has not yet begun. This is the period during which the raster beam which scans the data to the face of the display is retracing from the lower right corner of the screen to begin a new frame at the upper left hand corner of the screen. The period is called the vertical retrace.

Typically, the circuitry controlling the writing of information to the frame buffers will assert a signal indicating to the multiplexing circuitry that a write operation to the inactive frame buffer is complete and that the frame therein may be scanned to the display. This signal is used to switch the multiplexor to display data from the inactive frame buffer. Typically this signal is furnished by the central processing system. If the multiplexing circuitry is in the middle of transferring a frame of information to the display, that frame cannot be interrupted. Thus, the central processing system must continue to assert the signal until the frame is complete and the multiplexor can switch to scan data from the other frame buffer. Since the central processing system must continue to assert the signal, it cannot accomplish other of its tasks during this interval. This causes a significant reduction in the speed of operation of the computer.

SUMMARY OF THE INVENTION

It is, therefore, an object of the present invention to increase the operating speed of a computer.

It is another more specific object of the present invention to accurately select the instant to switch between two frame buffers being scanned to an output display.

These and other objects of the present invention are realized in a double buffered output display system comprising a first frame buffer, a second frame buffer, a multiplexor for furnishing data to an output display from one of the first or the second frame buffers, means for storing a signal indicating that the multiplexor is to select a different frame buffer to furnishing data to an output display, and means for furnishing the stored signal to the multiplexor only at the completion of a frame on a display and before a new frame commences.

These and other objects and features of the invention will be better understood by reference to the detailed description which follows taken together with the drawings in which like elements are referred to by like designations throughout the several views.

Notation And Nomenclature

Figure 1:
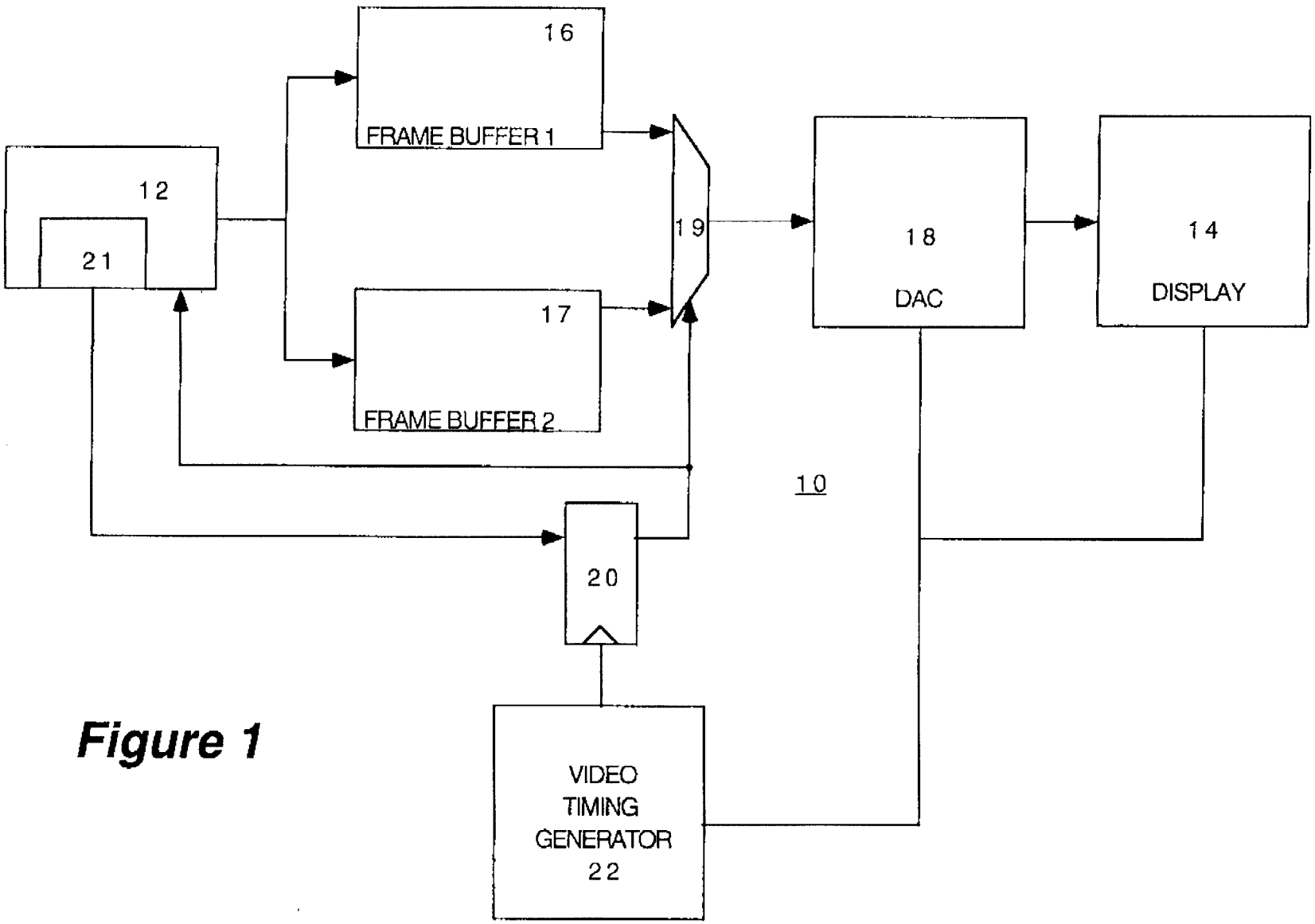
FIG. 1 is a block diagram of circuitry utilized in the invention.

Some portions of the detailed descriptions which follow are presented in terms of symbolic representations of operations on data bits within a computer memory. These descriptions and representations are the means used by those skilled in the data processing arts to most effectively convey the substance of their work to others skilled in the art. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary or desirable in most cases in any of the operations described herein which form part of the present invention; the operations are machine operations. Useful machines for performing the operations of the present invention include general purpose digital computers or other similar devices. In all cases the distinction between the method operations in operating a computer and the method of computation itself should be borne in mind. The present invention relates to apparatus for operating a computer in processing electrical or other (e.g. mechanical, chemical) physical signals to generate-other desired physical signals.

DETAILED DESCRIPTION OF THE INVENTION

Referring now to FIG. 1, there is illustrated a circuit 10 designed in accordance with the invention. The circuit 10 includes a rendering engine 12 which provides data to be displayed on a display 14. The rendering engine 12 may be a central processing unit or some other circuitry such as a graphics accelerator which provides data for display. In order to accomplish the transfer of the data from the rendering engine 12 to the output display 14, first and second frame buffers 16 and 17 are utilized.

In the circuit 10, data is written from the engine 12 to one frame buffer and scanned to the display 14 from the other. This is accomplished using a pair of VRAM frame buffers and multiplexing the entire frame of data in one of the frame buffers 16 or 17 to the display by means of a multiplexor 19. The data transferred by the multiplexor 19 is converted from digital to analog form by a digital-to-analog converter 18 and scanned to the display 14.

In this form of double buffering, data is never written to a frame buffer 16 or 17 during the time data is being scanned to the display 14 from that frame buffer. Once new data has been written to a frame buffer 16 or 17 to complete a new frame, the data in that frame buffer may in turn be scanned to the display 14; and new data may be written to the other frame buffer. Since data is never written to a frame buffer while its contents are being scanned to the display, frame tearing cannot occur.

As pointed out above, only whole frames are actually displayed one after another on the output display to create a picture. The instant at which scanning from one frame buffer must be switched to scanning from the other frame buffer must occur only after one frame is completed on the display and the next frame has not yet begun. The switch must thus occur during the vertical retrace period.

Typically, the circuitry controlling the writing of information to the frame buffers 16 and 17 will assert a signal indicating to the multiplexing circuitry that a write operation to the inactive frame buffer is complete and that the frame therein may be scanned to the output display. Typically this signal is furnished by the central processing system. If the multiplexing circuitry 19 is in the middle of transferring a frame of information to the display 14, that frame cannot be interrupted. Thus, the central processing system must continue to assert the signal until the frame is complete and the multiplexor 19 can switch to scan data from the other frame buffer. Since the central processing system must continue to assert the signal, it cannot accomplish other of its tasks during this interval. This causes a significant reduction in the speed of operation of the computer.

To eliminate this delay, the circuit 10 of the present invention includes a register 21 which receives and stores the signal from the circuitry controlling the writing to the frame buffers 16 and 17. Once the signal is stored in the register 21, the circuitry controlling the writing to the frame buffers may attend to other tasks. The signal in the register 21 is provided as an input to a register 20 which toggles the multiplexor 19 to scan data from the other frame buffer to the display. An enabling signal to furnish the signal in the register 20 to the multiplexor 19 is provided from the circuitry which controls the movement of the raster scan on the display. Typically, this circuitry resides within the video timing generator circuit 22. This circuitry generates a signal when the raster scan reaches the bottom of the display and vertical retrace begins. This is the signal provided as the enabling signal to the register 20.

The output of the register 20 is then used to toggle the multiplexor 19 from scanning the output of one frame buffer 16 or 17 to scanning the output of the other frame buffer to the display. Thus, the signal furnished by the circuitry controlling the writing to the frame buffers is stored in register 21 and is provided to toggle the multiplexor output only when the signal indicating the beginning of the vertical retrace is received by the register 20 from the video timing generator circuit 22. Consequently, the toggle between frame buffers occurs whenever the circuitry controlling the writing to the frame buffers indicates that a toggle should occur and the next vertical retrace period occurs. In this manner, the central processing unit is free to undertake other non-rendering operations and the speed of operation of the system is increased. Before the central processing unit can start rendering again, it must check to make sure that the scan is coming from the new frame buffer. It does this by looking at the output of register 20.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A double buffered output display system for displaying a plurality of frames of data, said double buffered output display system comprising:

a rendering engine for rendering said plurality of frames of data;

an output display for display of said plurality of frames of data;

a video timing generator, said video timing generator generating at least one timing signal, said timing signal having a vertical retrace period after complete scanning of a first display frame and before scanning of a next display frame, said video timing generator asserting an enabling signal during said vertical retrace period;

a first frame buffer, said first frame buffer coupled to receive a first frame of data from said rendering engine, said rendering engine writing said first frame of data when said output display is not displaying said first frame of data in said first frame buffer;

a second frame buffer, said second frame buffer coupled to receive a second frame of data from said rendering engine, said rendering engine writing said second frame of data when said output display is not displaying said second frame of data in said second frame buffer;

a multiplexor coupled to said first frame buffer and said second frame buffer for furnishing an output frame, said multiplexor furnishing said output frame by selecting from said first frame buffer or second frame buffer;

converter means coupled to said multiplexor and said output display, said converter means receiving said output frame from said multiplexor, said converter means converting said output frame from said multiplexor into a display signal for display on said output display;

input register means coupled to-said rendering engine for receiving and storing a frame completed signal from said rendering engine indicating that the multiplexor is to select a different frame buffer for generating said output frame; and output register means coupled to said input register means and coupled to said video timing generator to receive said enabling signal, said output register means generating an output signal when said enabling signal from said video timing generator is asserted after said frame completed signal has been received from said input register means, said output signal coupled to said multiplexor and said rendering engine such that said output signal switches said multiplexor and said output signal informs said rendering engine when said multiplexor has been switched;

such that said multiplexor switches between said first frame buffer and said second frame buffer only during said vertical retrace period of said timing signal and informs said rendering engine when a switch occurs.

2. A double buffered output display system as claimed in claim 1 in which the rendering engine does not begin rendering after sending said frame completed signal to said input register means until said rendering engine receives the output signal from the output register means.

3. In a double buffered output display system comprising an output display, a first frame buffer, a second frame buffer, a rendering engine for writing data to said first frame buffer and second frame buffer, a multiplexor for furnishing data from either the first frame buffer or the second frame buffer to a converter means, said converter means converting said data into an analog display signal and passing said analog display signal to said output display, a register means for controlling said multiplexor, a video timing generator having a vertical retrace period after displaying a first display frame and before displaying a next display frame, a method for switching between said first frame buffer and said second frame buffer in said double buffered output display system, said method comprising the steps of:

converting a first frame of data received from said first frame buffer through said multiplexor into said analog display signal displayed onto said output display using said converter means;

rendering a second frame of data using said rendering engine into said second frame buffer during the converting of said first frame of data;

signaling said register means with a frame completed signal when said rendering engine has completed rendering said second frame of data, said rendering engine free to perform nonrendering processing;

switching said multiplexor when said timing signal enters a next vertical retrace period such that said converting means now converts data from said second frame buffer into said analog display signal displayed onto said output display; and signaling said rendering engine when said multiplexor has switched from said first frame buffer to said second frame buffer such that rendering engine is informed that it may render into said first frame buffer;

such that said multiplexor only switches between said first frame buffer and said second frame buffer during a vertical retrace period.

4. The method for switching between said first frame buffer and said second frame buffer in said double buffered output display system as set forth in claim 3, wherein said rendering engine begins rendering in said second frame buffer only after being informed that said multiplexor has switched.

* * * * *